US008295530B2

(12) United States Patent
Grell

(10) Patent No.: US 8,295,530 B2
(45) Date of Patent: Oct. 23, 2012

(54) HEADPHONES AND HEADSET

(75) Inventor: Axel Grell, Burgdorf (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 276 days.

(21) Appl. No.: 12/683,285

(22) Filed: Jan. 6, 2010

(65) Prior Publication Data

US 2011/0164775 A1 Jul. 7, 2011

(51) Int. Cl.
*H04R 25/00* (2006.01)

(52) U.S. Cl. ..... 381/378; 381/370; 381/376

(58) Field of Classification Search ..... 381/371, 381/370, 372, 378
See application file for complete search history.

(56) References Cited

U.S. PATENT DOCUMENTS 3,862,379 A * 1/1975 Pless ..... 381/74
2007/0044206 A1 * 3/2007 Sato et al. ..... 2/209
2007/0071269 A1 * 3/2007 Milde ..... 381/378

* cited by examiner

*Primary Examiner* — Yuwen Pan
*Assistant Examiner* — Taunya McCarty
(74) *Attorney, Agent, or Firm* — Kilpatrick Townsend & Stockton LLP

(57) ABSTRACT

Headphones comprising a headband (10) having a first and second end. A first and second earpiece (20) is attached to the first and second end of the headband (10), respectively. The headband comprises a first and second spring layer (11, 12) and an intermediate dampening layer (13) arranged between the first and second spring layer (11, 12).

9 Claims, 4 Drawing Sheets

HEADPHONES AND HEADSET

The present invention relates to headphones or headsets.

Headphones or headsets typically comprise a headband having two ends, to which an earpiece is attached, respectively. The earpieces each comprise an electro-acoustic transducer and an ear cushion. The ear cushions are provided to allow a comfort usage of the headphones or headsets even over a longer period of time.

FIG. 1 shows a schematic representation of a headphone according to the prior art. The headphone 1 comprises a headband 10, two earpieces 20 at the two ends of the headband 10. The earpieces 20 also comprise ear cushions 30. A headband 10 may typically act as a spring such that the ends of the headband and the headband itself can oscillate. The earpieces are placed over the ears of the user of the headphone. Accordingly, the headband must be designed to ensure that the earpieces of the headphone are pressed against the ears of the user with a certain pressing force to enable a secure fitting of the headphone. On the other hand, ear cushions are provided to ensure a wearing comfort for the user. In other words, there is a trade-off between the fitting of the headphone and the comfort for the user.

The headband of the headphone is typically designed to have a bias. In the resting position, the distance between the two earpieces will be less than the distance between two ears of a user. In order wear the headphone, the earpieces and therefore the headband must be biased by enlarging the distance between the earpieces. The optimum pressuring force is then achieved when the earpieces are placed on the ear or on the head of a user. In this case, the headband can act as a biased spring.

FIG. 2 shows a basic representation of a spring-mass system representing the headphone according to FIG. 1. The first and second mass m1, m2 represent the earpieces and between the two earpieces a spring F is implemented by the headband 10. Accordingly, a mechanical module of the spring-mass system of the headphone of FIG. 1 is depicted in FIG. 2. The headphone with the headband is a system which can oscillate and has a resonant frequency which can be in the range between 10 and 100 Hz. When the electro-acoustic transducers in the earpieces output an audio signal which comprises parts of the resonant frequency of the headband, the complete system can oscillate. Such an oscillation of the headband can lead to a sound which is called the headband resonance. This sound can be superimposed on an audio signal from the electro acoustic transducers in the earpieces and lead to a distortion of this audio signal.

It is therefore an object of the invention to provide headphones or a headset with a headband with an improved capability of dealing with a resonance in the headband.

This object is solved by a headset according to claim 1.

Therefore, headphones having a headband with a first and second end are provided. The headphones furthermore comprise first and second earpieces, which are attached to the first and second end of the headband. The headband also comprises a first and second spring layer as well as an intermediate dampening layer which is arranged between the first and second spring layer. By means of the intermediate damping layer, the oscillation of the headband can be reduced.

According to an aspect of the invention, the first and second spring layers are partially or entirely attached to the intermediate dampening layer.

According to a further aspect of the invention, the first and second spring layers are partially or entirely glued to the intermediate dampening layer.

According to a further aspect of the invention, the first and second spring layers are partially or entirely glued to the intermediate dampening layer.

The invention also relates to a headset comprising a headband with a first and second end to which a first and a second earpiece are attached. The headband comprises a first and second spring layer as well as an intermediate dampening layer arranged between the first and second spring layer.

The invention relates to the idea to provide a headphone with a headband to which earpieces are coupled. The headband comprises several layers. In particular a first and second layer of a material is provided which has the characteristics of a spring. An intermediate dampening layer is arranged between the first and second spring layer. This intermediate layer has a dampening characteristic. The first and second spring layers are at least partially connected to the intermediate dampening layer. Preferably, the first and second layers are glued to the intermediate layer. Accordingly, the dampening layer will reduce the oscillation of the first and second spring layer. Accordingly, a rise of the resonance is avoided. By avoiding the rise of the resonance any sound produced by the headband resonance is reduced or eliminated.

Further aspects of the invention are defined in the dependent claims.

Advantages and embodiments of the invention will now be described in more detail with reference to the figures.

Figure 1:
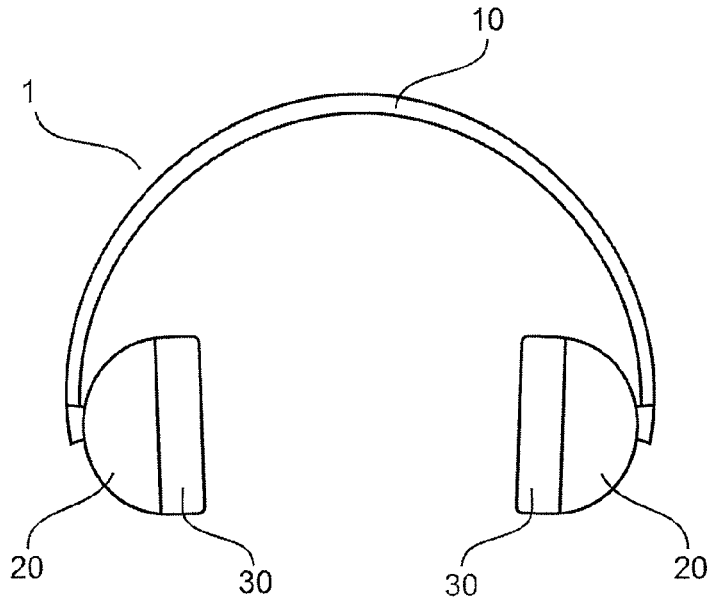
FIG. 1 shows a schematic representation of a headphone according to the prior art.
Figure 2:
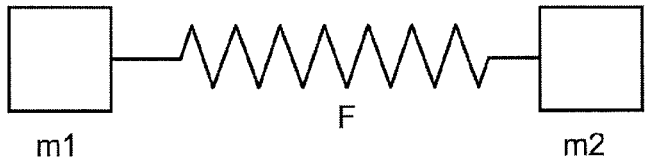
FIG. 2 shows a schematic representation of the mechanical spring-mass system of the headphone according to FIG. 1.

The headphone or the headset according to a first embodiment is based on the headphone according to FIG. 1 and comprises a headband 10 and two ear pieces 20 with ear cushions 30 at the two ends of the headband.

Figure 3:
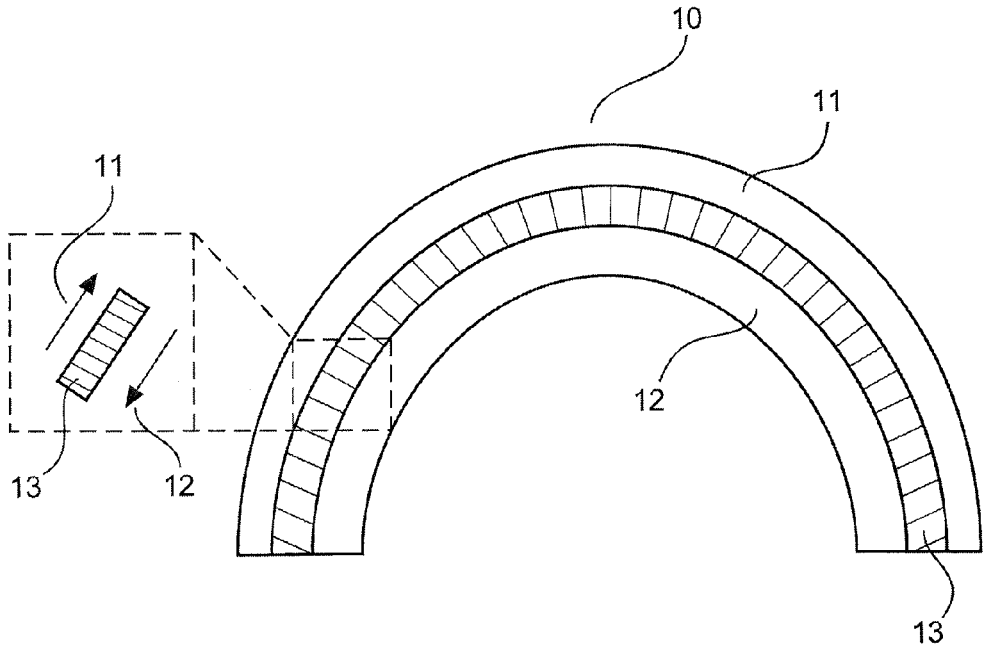
FIG. 3 shows a schematic representation of a headband for a headphone according to a first embodiment.

FIG. 3 shows a schematic cross-section of a headband 10 according to the first embodiment. The headband 10 comprises a first and second spring layer 11, 12 with an intermediate dampening layer 13. The first and second spring layers 11, 12 are, for example, of stainless steel or are of spring steel. The intermediate dampening layer 13 is preferably a plastic layer. The first and second spring layers 11, 12 can be glued to the intermediate dampening plastic layer 13. The first and second spring layers can be glued partially or entirely to the intermediate plastic layer 13. If the headband 10 is biased, a movement between the first and second spring layers 11, 12 and the intermediate dampening plastic layer 13 will be present. The dampening plastic layer 13 should have the characteristic that the deformation or distortion introduced by the movement of the first and second spring layers 11, 12 is transformed into heat. Therefore, the energy, which has been transformed to heat, can not be used again as kinetic energy in the spring-mass system of the headphone according to a first embodiment.

If the headband is distorted, for example by pulling the earpieces away from each other, the first and second spring layers 11, 12 will be displace relative to each other as depicted in FIG. 3. If the first and second spring layers 11, 12 are attached by their entire surface to the plastic dampening layer 13 a movement of the first and second spring layers will be in opposite direction as depicted in FIG. 3.

Figure 4:
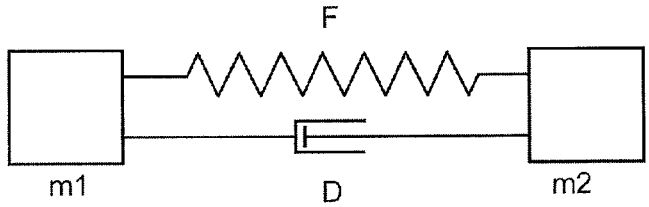
FIG. 4 shows a schematic representation of a mechanical spring-mass system of the headphone according to the first embodiment.

FIG. 4 shows a schematic representation of a mechanic spring-mass system of a headphone according to the first embodiment. The two earpieces are represented by the two masses m1, m2. The headband 10 is represented by a spring F parallel to a dampening element D. Accordingly, the dampening plastic layer 13 acts as a dampening element D, which is proportional to the velocity of the deformation. By means of the dampening element D parallel to the spring F, the entire system is damped and a rise of the resonance can be avoided. Accordingly, any sound or oscillation, which results from the headband resonance, is reduced or suppressed.

Figure 5:
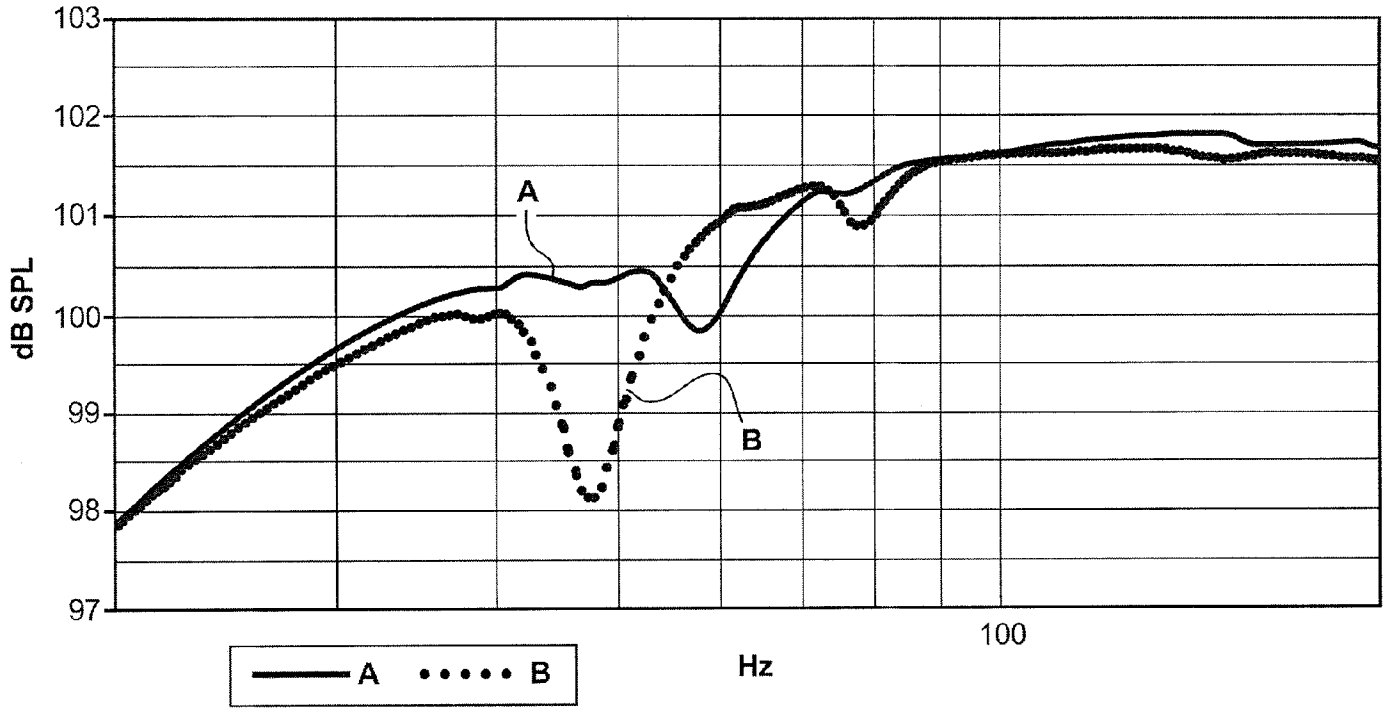
FIG. 5 shows a graph of the frequency response of a headphone according to the first embodiment and according to the prior art.

FIG. 5 shows a frequency response of a headphone according to the prior art and according to the first embodiment. The headband response according to the first embodiment is the curve A and the frequency response of the headband according to the prior art is the curve B. Accordingly, the headband according to the first embodiment does not comprise any brake in its frequency response.

Figure 6B:
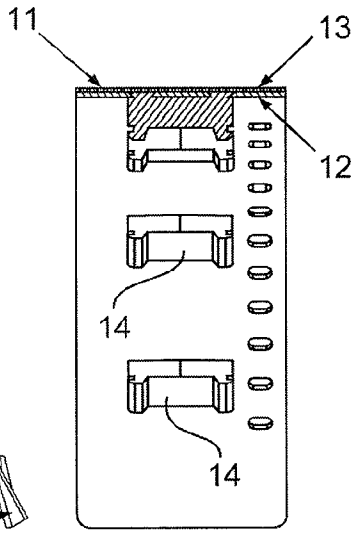
FIG. 6B shows a sectional view along the lines F-F in FIG. 6A.
Figure 6A:
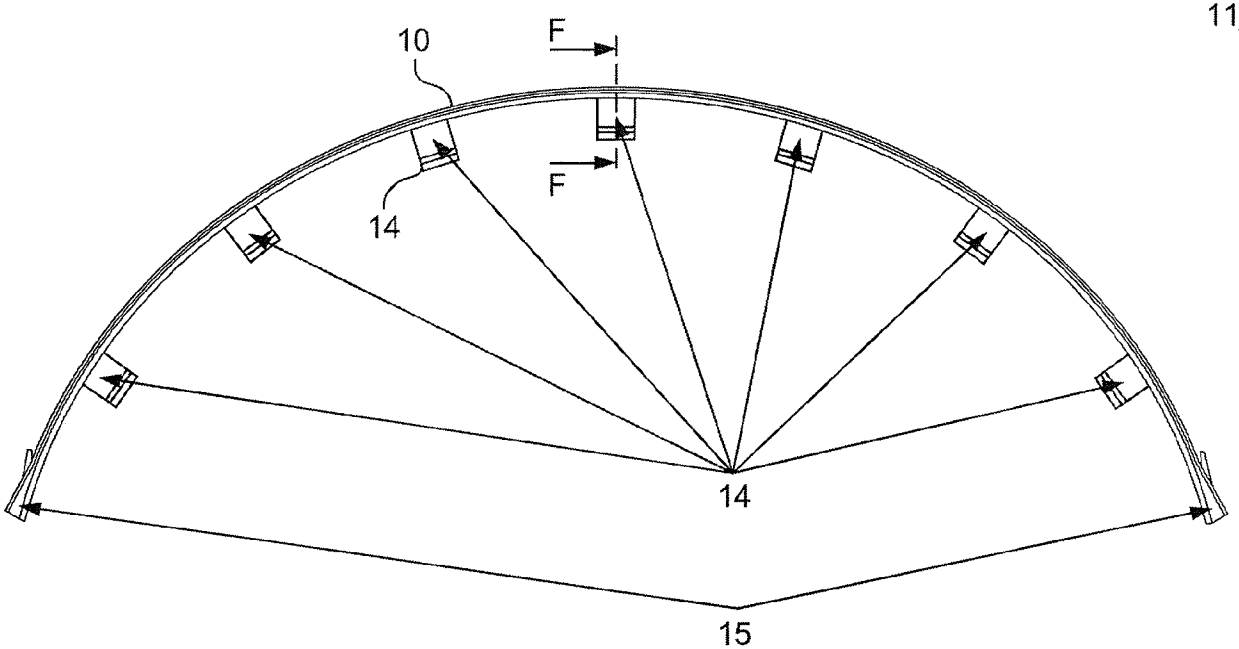
FIG. 6A shows a plane view of a headband for a headphone according to a second embodiment.

FIG. 6A shows a side view of a headband according to a second embodiment and FIG. 6B shows a cross-section along the line F-F in FIG. 6A. In FIG. 6A, a headband 10 is depicted, which comprises a plurality of holders or holding elements 14. At the two ends of the headband, optionally mufflers 15 can be provided respectively. The holders 14 may be used to a attached headband cushion.

In FIG. 6B, the first spring layer 11, the second spring layer 12 and the intermediate dampening layer 13 are depicted. The first spring layer 11 can be implemented as a frame glue plate, for example of stainless steel. The second spring layer 12 can be implemented as a plate spring steel. The intermediate dampening layer 13 can be implemented as a double sided adhesive tape. In FIG. 6B, the holders 14 are also depicted.

A pressing force of the ear pieces against the ears or head of a user should be in the range 2 and 5 N.

A headset according to the invention can be based on the headphones according to the first and second embodiment. The headset may also comprise a boom microphone.

According to an alternative embodiment the headband of a headset or a headphone may comprise a spring material which also has a specific dampening characteristic.

What is claimed:

1. Headphones, comprising:

a headband having a first end and a second end, a first earpiece and a second earpiece which are attached to the first end and the second end of the headband, respectively, wherein the headband comprises a first spring layer, a second spring layer, and an intermediate dampening layer each extending substantially from the first end to the second end of the headband, the intermediate dampening layer arranged between the first spring layer and the second spring layer, the first spring layer and the second spring layer each coupled to the intermediate dampening layer such that the intermediate dampening layer reduces oscillation of the first spring layer and the second spring layer.

2. The headphones according to claim 1, wherein the first spring layer and the second spring layer are partially attached to the intermediate dampening layer.

3. The headphones according to claim 1, wherein the first spring layer and the second spring layer are partially glued to the intermediate dampening layer.

4. Headset, comprising, a headband having a first end and a second end, a first earpiece and a second earpiece which are attached to the first end and the second end of the headband, respectively, wherein the headband comprises a first spring layer, a second spring layer, and an intermediate dampening layer each extending substantially from the first end to the second end of the headband, the intermediate dampening layer arranged between the first spring layer and the second spring layer, the first spring layer and the second spring layer each coupled to the intermediate dampening layer such that the intermediate dampening layer reduces oscillation of the first spring layer and the second spring layer.

5. The headphones according to claim 1, wherein the first spring layer and the second spring layer are entirely attached to the intermediate dampening layer.

6. The headphones according to claim 1, wherein the first spring layer and the second spring layer are entirely glued to the intermediate dampening layer.

7. The headphones according to claim 2, wherein the first spring layer and the second spring layer are partially glued to the intermediate dampening layer.

8. The headphones according to claim 5, wherein the first spring layer and the second spring layer are partially glued to the intermediate dampening layer.

9. The headphones according to claim 5, wherein the first spring layer and the second spring layer are entirely glued to the intermediate dampening layer.

* * * * *

UNITED STATES PATENT AND TRADEMARK OFFICE

CERTIFICATE OF CORRECTION

PATENT NO. : 8,295,530 B2
APPLICATION NO. : 12/683285
DATED : October 23, 2012
INVENTOR(S) : Grell It is certified that error appears in the above-identified patent and that said Letters Patent is hereby corrected as shown below:

Title Page, In the Abstract:

In the second column of the face sheet, at Item (57), lines 2-3, please delete "A first and second earpiece (20) is attached to the first and second end of the headband (10), respectively" and insert --A first earpiece and a second earpiece (20) are attached to the first and second ends of the headband (10), respectively--.

In the second column of the face sheet, at Item (57), lines 3-6, please delete "The headband comprises a first and second spring layer (11, 12) and an intermediate dampening layer (13) arranged between the first and second spring layer (11, 12)" and insert --The headband comprises a first spring layer and a second spring layer (11, 12) and an intermediate dampening layer (13) arranged between the first and second spring layers (11, 12)--.

In the Specification:

Column 1, Line 8: please delete "a comfort" and insert --comfortable--.
Column 1, Line 28: after "In order" please insert --to--.
Column 1, Line 36: please delete "mass" and insert --masses--.
Column 1, Line 60: please delete "layer" and insert --layers--.
Column 2, Line 1: please delete the first paragraph starting with "According" at the top of column 2 (it is identical to the preceding paragraph).
Column 2, Line 5: please delete "a first and second end" and insert --a first end and a second end--.

Signed and Sealed this
Nineteenth Day of February, 2013

Teresa Stanek Rea
*Acting Director of the United States Patent and Trademark Office*

Column 2, Line 5: please delete “a first and a second earpiece” and insert --a first earpiece and a second earpiece--.

Column 2, Line 6: please delete “a first and second spring layer” and insert --a first spring layer and a second spring layer--.

Column 2, Line 8: please delete “the first and second spring layer” and insert --the first and second spring layers--.

Column 2, Line 11: please delete “a first and second layer of a material is” and insert --first and second layers of a material are--.

Column 2, Line 19: please delete “the first and second spring layer” and insert --the first and second spring layers--.

Column 2, Line 49: please delete “a first and second spring layer” and insert --first and second spring layers--.

Column 3, Line 5: please delete “direction” and insert --directions--.

Column 3, Line 30: please delete “a attached” and insert --attach a--.

Column 3, Line 42: please delete “embodiment” and insert --embodiments--.